United States Patent [19]

Hochstrasser et al.

[11] Patent Number: 4,735,295

[45] Date of Patent: Apr. 5, 1988

[54] APPARATUS FOR GENERATING HOISTWAY DATA IN AN ELEVATOR

[75] Inventors: Hans Hochstrasser, Lucerne; Renato Ferrario, Wassen; Kenneth Smith, Mézières, all of Switzerland

[73] Assignee: Inventio AG, Hergiswil, Switzerland

[21] Appl. No.: 943,262

[22] PCT Filed: Feb. 18, 1986

[86] PCT No.: PCT/CH86/00022

§ 371 Date: Dec. 1, 1986

§ 102(e) Date: Dec. 1, 1986

[30] Foreign Application Priority Data

Apr. 3, 1985 [CH] Switzerland ..... 01436/85

[51] Int. Cl.[4] ..... B66B 3/02

[52] U.S. Cl. ..... 187/134

[58] Field of Search ..... 187/134, 136

[56] References Cited

U.S. PATENT DOCUMENTS

| | | | |
|---|---|---|---|
| 4,108,282 | 8/1978 | Satoh et al. | 187/134 |
| 4,134,476 | 1/1979 | Zolnerovich, Jr. et al. . | |
| 4,341,287 | 7/1982 | Kuzunuki et al. | 187/134 |
| 4,387,436 | 6/1983 | Katayama et al. | 187/134 X |
| 4,494,628 | 1/1985 | Uherek et al. . | |

FOREIGN PATENT DOCUMENTS

| | | |
|---|---|---|
| 1584118 | 12/1969 | France . |
| 2261966 | 9/1975 | France . |
| 2349168 | 11/1977 | France . |
| 2063521 | 6/1981 | United Kingdom . |

*Primary Examiner*—William M. Shoop, Jr.
*Assistant Examiner*—W. E. Duncanson, Jr.
*Attorney, Agent, or Firm*—Werner W. Kleeman

[57] ABSTRACT

Hoistway data which are indicative of predetermined elevator car positions at respective predeterminate hoistway locations, are generated without installations of actuating members in the elevator hoistway and transmitters at the elevator car. For this purpose, a memory is provided and has stored predeterminate positional numbers representative of the predeterminate hoistway locations. The predeterminated positional numbers are transmitted to a register in a travel direction dependent sequence during travel of the associated elevator car. A pulse transmitter is driven by the elevator car and the thus generated pulses are summed-up in a counter to positional numbers which correspond to respective car positions. The positional numbers of the counter and the predeterminate positional numbers transmitted to the register are compared with one another during travel in a comparator during elevator car travel. In case of identity, a signal representing a hoistway datum is generated and a switching member associated with the respective hoistway location is activated.

5 Claims, 1 Drawing Sheet

APPARATUS FOR GENERATING HOISTWAY DATA IN AN ELEVATOR

BACKGROUND OF THE INVENTION

The present invention relates to a new and improved construction of an apparatus for generating hoistway data in an elevator.

In its more particular aspects the present invention specifically relates to a new and improved construction of an apparatus for generating hoistway data in an elevator. In such apparatus, an elevator car is connected with a position transmitter by means of which there can be determined elevator car positions which are coincident at least with predetermined hoistway locations.

Predetemined hoistway locations are represented by binary numbers in an elevator control system as known, for example, from Swiss Patent No. 357,173. For the purpose of generating signals corresponding to the binary numbers, a coding apparatus is proposed in which four transmitted elements in the form of snap action switches fastened to the elevator car and by means of which two different stationary switching conditions can be produced. These snap action switches are actuated when the elevator car passes-by actuating members in the form of slideways positioned in the elevator hoistway. In order to keep the number of actuating members as small as possible, the coding is based on the Gray code and in this manner only one actuating member is required per hoistway location. The coding apparatus, which operates on a mechanical principle, is prone to malfunction so that faulty switching operations can occur.

In an apparatus as known, for example, from Swiss Patent No. 622,226, the aforementioned disadvantage is avoided. In this apparatus the transmitters fastened to the elevator car, comprise bi-stable magnetic switches and the actuating members which are arranged in the elevator hoistway, comprising switching magnets.

One disadvantage of the above described apparatuses lies in the fact that the expenditure required for support means for the installation of the actuating members in the elevator hoistway as well as for the installation and setting-up operations is substantial and even increases with the number of floors and the hoistway data necessary for the control system. Moreover, four-digit transmitters are not sufficient in many elevator installations for collecting all hoistway data so that more than four conductors must be provided in the travelling cable for the signal transmission.

An actual value transmitter associated with a position control circuit and as known for example from European Patent No. 0,026,406, comprises a pulse transmitter in the form of a digital tachometer. The digital tachometer is driven by the elevator car by means of a cable of an overspeed governor and generates one pulse for every 0.5 mm of travel distance. The pulses are summed up in a car travel distance counter to positional numbers which are utilized as actual values for the regulation of travel.

SUMMARY OF THE INVENTION

Therefore, with the foregoing in mind it is a primary object of the present invention to provide a new and improved construction of an apparatus for generating hoistway data in an elevator and which apparatus is not afflicted with the drawbacks and limitations of the prior art constructions heretofore discussed.

A more specific object of the present invention is directed to a new and improved construction of an apparatus for generating hoistway data in an elevator and which apparatus is associated with constructional expenditure substantially independent of the number of hoistway data and floors.

A further significant object of the present invention aims at providing a new and improved construction of an apparatus for generating hoistway data in an elevator and which apparatus requires fewer hoistway installations and fewer conductors in the travelling cable as compared to the state of the art.

Now in order to implement these and still further objects of the invention, which will become more readily apparent as the description proceeds, the apparatus of the present development is manifested by the features that, there is provided therein a memory in which positional numbers designating predetermined hoistway locations are stored and which positional numbers are suquentially transmitted to a register during the course of travel and depending upon the travel direction. The position transmitter comprises a counter in which there are formed during travel, positional numbers corresponding to the current position of the elevator car. The register and the counter are connected with a comparator which compares the positional numbers with one another. If equal, a signal representing a hoistway datum is generated and a switching member associated with the respective hoistway location is activated.

One of the advantages by the invention is seen in the fact that position transmitters attached to the elevator car are no longer necessary, whereby the conductors required for the signal transmission in the travelling cable can be dispensed with. The installations of actuating members which cooperate with the position transmitters in the elevator hoistway likewise become unnecessary so that substantial costs can be saved.

BRIEF DESCRIPTION OF THE DRAWING

The invention will be better understood and objects other than those set forth above will become apparent when consideration is given to the following detailed description thereof. Such description makes reference to the annexed single drawing which shows a schematic illustration of an exemplary embodiment of the inventive apparatus.

DETAILED DESCRIPTION OF THE PREFERRED EMBODIMENTS

Figure 1:
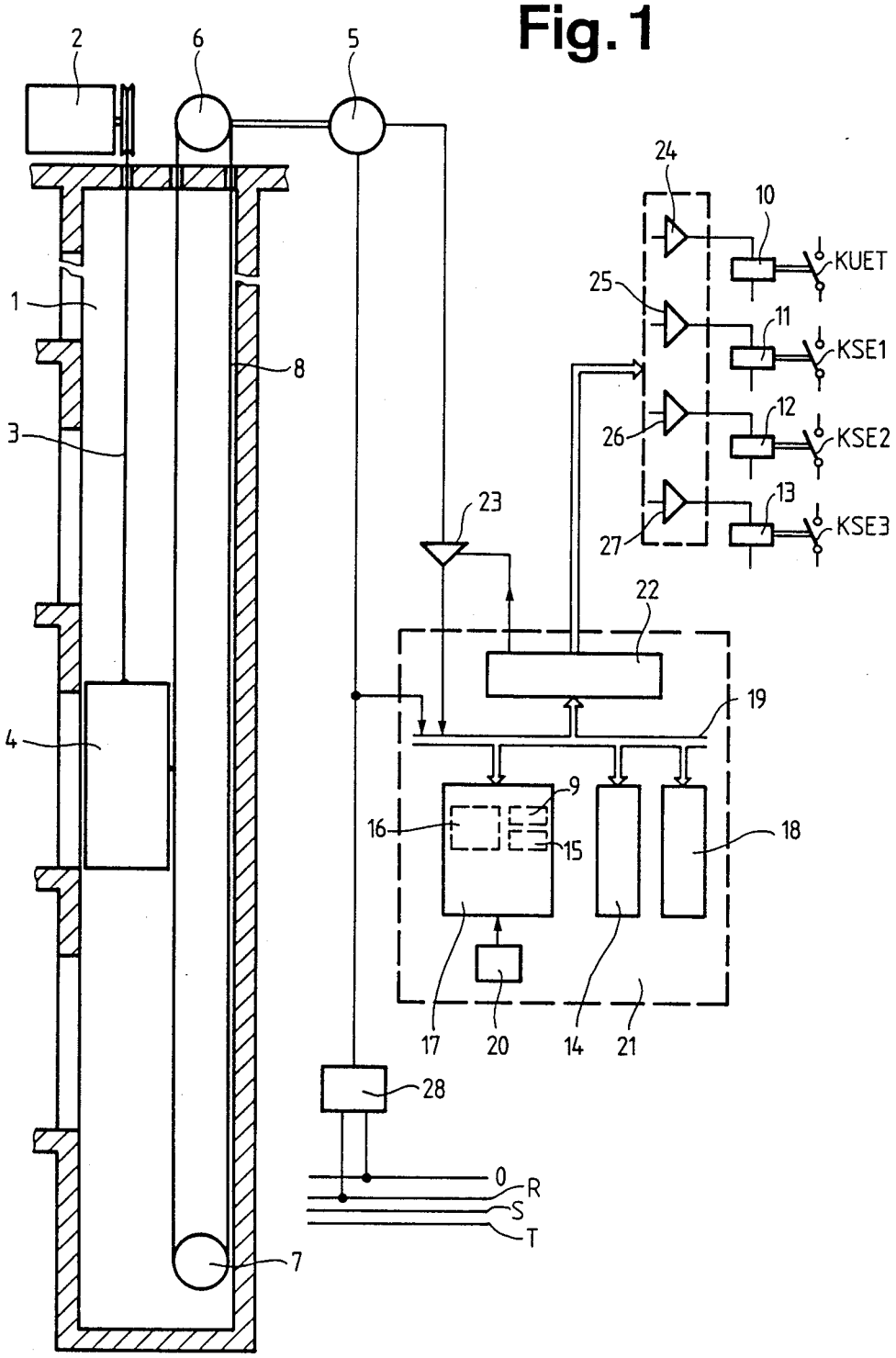

Describing now the drawing, it is to be understood that only enough of the construction of the apparatus for generating hoistway data has been shown as needed for those skilled in the art to readily understand the underlying principles and concepts of the present development, while simplifying the showing of the drawing. Turning attention now specifically to the single FIGURE of the attached drawing, there has been illustrated therein by way of example and not limitation.

In FIG. 1 an elevator hoistway designated by reference character 1. Therein, an elevator car 4 is guided and driven by means of a hoist machine 2 via a hoist cable 3. A pulse transmitter 5 in the form of a digital tachometer is coupled with a drive sheave 6 which is drivable by a strap 8 fastened to the elevator car 4 and guided around a deflection roll 7 arranged at the lower end of the hoistway 1. The transmission of torque to the drive sheave 6 is effected by means of a positive locking connection, for example, perforations provided in the strap 8 into which teeth engage which are arranged at the drive sheave 6.

The pulse transmitter 5 and a counter 9 form a position transmitter, wherein the pulse transmitter 5 generates, for example, one pulse per 1 mm of travel distance of the elevator car 4 and the pulses are summed-up in the counter 9 to positional numbers which correspond to the respective car position and are related to a predetermined basis, for example, the car floor when the elevator car 4 is at the lower stop.

Contacts of a safety circuit are actuatable at predetermined hoistway locations during the passage of the elevator car 4 by means of switching members 10, 11, 12, 13, for example, in the form of relays, and are designated by KUET, KSE1, KSE2 and KSE3. One contact thereof, for example, the contact KUET, constitutes a door contact overbridging connection which is to be switched in the door region during travel, and the other contacts KSE1, KSE2 and KSE3 constitute hoistway limit switches by means of which the deceleration of the elevator car 4 can be controlled during levelling-in into a final stop position.

The predetermined hoistway locations are represented by positional numbers which are stored in a memory 14 which is connected with a register 15. The register 15 and the counter 9 of the position transmitter are connected to a comparator 16. In this arrangement the register 15 and the counter 9 are registers of a microprocessor 17 whose arithmetic unit forms the comparator 16. The memory 14 in the form of a read-write memory, the microprocessor 17 and a read-only memory 18 are interconnected through a bus 19 and conjointly with a clock generator 20 form a microcomputer 21. An address decoder 22 is connected by its inputs to the bus 19 and by an output to a bus driver 23. The bus driver 23 is connected on its input side to the pulse transmitter 5 and on its output side to a data line of the bus 19. Further outputs of the address decoder 22 are connected to further bus drivers 24, 25, 26 and 27 which are connected on their output sides to the relays 10, 11, 12 and 13. The microcomputer 21 and the pulse transmitter 5 are connected with a buffered power supply 28 connected to a three-phase network RSTO so that operation of the apparatus is ensured in the case of power voltage failure.

The apparatus described hereinbefore operates as follows:

After the start of the elevator car 4, the bus driver 23 is activated by means of the address decoder 22 so that the pulses generated by the pulse transmitter 5 can be transmitted and summed-up to positional numbers in the counter 9. Then, the positional number of the specific hoistway location which is closest to the starting location of the elevator car 4 in the direction of travel, is transferred from the memory 14 into the register 15. During the course of travel, the positional numbers of the counter 9 and of the register 15 are continuously compared with one another in the comparator 16. If equal, the address of the positional number of the respective hoistway location is decoded in the address decoder 22 and the associated bus driver is activated, whereupon the series-connected relay is energized and its contact is actuated. Thereafter, the positional number of the following predetermined hoistway location which is closest in the direction of travel, is transferred into the register 15 and the procedure continues in the previously described manner.

While there are shown and described present preferred embodiments of the invention, it is to be distinctly understood that the invention is not limited thereto, but may be otherwise variously embodied and practiced withing the scope of the following claims. Accordingly,

What we claim is:

1. An apparatus for generating hoistway data in an elevator system containing at least one elevator car, said apparatus comprising:

a position transmitter operatively connected to at least one elevator car of the elevator system;

a memory having stored therein predeterminate positional numbers representative of predeterminate hoistway locations;

a register operatively connected with said memory;

said register receiving from said memory, a travel direction dependent sequence of predeterminate positional numbers during travel of said at least one elevator car;

said position transmitter comprising a counter forming positional numbers which correspond to respective positions of said at least one elevator car during its travel;

a comparator;

said comparator being operatively connected to said counter and said register for comparing, during travel of said at least one elevator car, said positional numbers formed by said counter and said predeterminate positional numbers received by said register;

a predeterminate number of switching members associated with said predeterminate hoistway locations; and said comparator, in the event of identity of one of said positional numbers formed by said counter and one of said predeterminate positional numbers received by said register, generating a signal representative of a respective one of said predeterminate hoistway locations for activating a respective one of said predeterminate number of switching members associated with a respective one of said predeterminate hoistway locations.

2. The apparatus as defined in claim 1, further including:

a microcomputer;

said microcomputer incorporating said memory having stored therein said predeterminate positional numbers representative of said predeterminate hoistway locations, said register operatively connected to said memory, said counter and said comparator as components of said microcomputer;

said memory constituting a read-write memory; and a microprocessor constituting a component of said microcomputer and incorporating said comparator.

3. The apparatus as defined in claim 1, wherein:

said position transmitter further comprises a pulse transmitter;

said pulse transmitter constituting a digital tachometer drivingly connected to said at least one elevator car;

a drive sheave;

said pulse transmitter being coupled to said drive sheave;

a strap fastened to said at least one elevator car and trained around said drive sheave; and said strap fastened to said at least one elevator car, being drivingly connected to said drive-sheave in a substantially slip-free manner by means of a positive locking connection and transmitting torque to said drive sheave during travel of said at least one elevator car.

4. The apparatus as defined in claim 2, further including:

a buffered power supply; and said microcomputer and said pulse transmitter being connected to said buffered power supply.

5. An apparatus for generating hoistway data in an elevator system containing at least one elevator car, said apparatus comprising:

a position transmitter operatively connected to at least one elevator car of the elevator system;

a memory having stored therein predeterminate positional numbers representative of predeterminate hoistway locations;

a register operatively connected with said memory;

said register receiving from said memory, a travel direction dependent sequence of said predeterminate positional numbers during travel of said at least one elevator car;

said position transmitter comprising a counter forming positional numbers which correspond to respective positions of said at least one elevator car during its travel;

a comparator;

said comparator being operatively connected to said counter and said register for comparing, during travel of said at least one elevator car, said positional numbers formed by said counter and said predeterminate positional numbers received by said register;

a drive sheave;

said pulse transmitter being coupled to said drive sheave;

a strap fastened to said at least one elevator car and positively lockingly connected to said drive sheave in a substantially slip-free manner and trained around said drive sheave for transmitting torque to said drive sheave during travel of said at least one elevator car;

a predeterminate number of switching members associated with said predeterminate hoistway locations; and said comparator, in the event of identity of one of said positional numbers formed by said counter and one of said predeterminate positional numbers received by said register, generating a signal representative of a respective one of said predeterminate hoistway locations for activating a respective one of said predeterminate number of switching members associated with a respective one of said predeterminate hoistway locations.

* * * * *

UNITED STATES PATENT OFFICE
CERTIFICATE OF CORRECTION

PATENT NO. : 4,735,295
DATED : April 5, 1988

INVENTOR(S) : Hans Hochstrasser et al

It is certified that error appears in the above-identified patent and that said Letters Patent are hereby corrected as shown below:

In the Abstract, line 6, after "stored" please insert --therein--

In the Abstract, line 8, after "The" please delete "predeterminated" and insert --predeterminate--

In the Abstract, line 17, after "other" please delete "during travel"

Column 1, line 19, after "four" please delete "transmitted" and insert --transmitter--

Column 2, line 22, after "are" please delete "suquentially" and insert --sequentially--

Column 2, line 33, after "advantges" please insert --achieved--

Column 2, line 61, after "limitation" please delete "." (period)

Column 2, line 62, please delete "In FIG. 1"

UNITED STATES PATENT AND TRADEMARK OFFICE

CERTIFICATE OF CORRECTION

PATENT NO. : 4,735,295

DATED : April 5, 1988

INVENTOR(S) : Hans Hochstrasser et al

It is certified that error appears in the above-identified patent and that said Letters Patent is hereby corrected as shown below:

Column 4, line 7, after "practiced" please delete "withing" and insert -- within --.

Signed and Sealed this

Thirtieth Day of August, 1988

*Attest:*

*Attesting Officer*

DONALD J. QUIGG

*Commissioner of Patents and Trademarks*